United States Patent [19]

Marass et al.

[11] Patent Number: 4,625,956

[45] Date of Patent: Dec. 2, 1986

[54] APPARATUS FOR FORMING A STACK OF SHEETS

[75] Inventors: Josef Marass, Seehausen b. Murnau; Rudolf Liepert, Augsburg; Klaus Weyrich, Rosenheim, all of Fed. Rep. of Germany

[73] Assignee: Fa. Georg Spiess GmbH, Gersthofen, Fed. Rep. of Germany

[21] Appl. No.: 724,916

[22] Filed: Apr. 19, 1985

[30] Foreign Application Priority Data

May 7, 1984 [DE] Fed. Rep. of Germany ..... 3418344

[51] Int. Cl.[4] ..... B65H 29/68

[52] U.S. Cl. ..... 271/183; 271/176; 271/195; 271/309

[58] Field of Search ..... 271/182, 183, 195, 196, 271/211, 309, 176

[56] References Cited

U.S. PATENT DOCUMENTS 3,814,415 6/1974 Hunter ..... 271/176 X
3,941,374 3/1976 Vits ..... 271/183
4,019,731 4/1977 Vits ..... 271/183

FOREIGN PATENT DOCUMENTS 2105875 3/1983 United Kingdom ..... 271/176

*Primary Examiner*—Richard A. Schacher
*Attorney, Agent, or Firm*—Collard, Roe & Galgano

[57] ABSTRACT

In the case of an apparatus for forming a stack of sheets comprising a brake means placed at (in terms of sheet motion) the leading edge of the stack and downstream from a sheet transport means, the brake means having at least one brake roller driven at a lower peripheral speed than the speed of transport of the sheets and a timed sheet nip member adapted to engage a sheet and move it towards the brake roller, one aim of the invention is to ensure reliable retardation and straightening of the sheets without damage to them. In order to attain this objective the brake means, whose sheet nip member or members is in the form of at least one segment able to be driven at a speed equal to the speed of the braking roller cooperating therewith when tripped by the sheet, is placed at the downstream end of at least one suction belt designed to receive the respective sheets from a sheet processing machine, and at least one blow tube is placed over the stack and downstream from the said brake roller, such blow tube, that is supplied with air under pressure, having at least one nozzle generally directed in the direction of sheet transport.

19 Claims, 6 Drawing Figures

APPARATUS FOR FORMING A STACK OF SHEETS

BACKGROUND OF THE INVENTION

The invention relates to an apparatus for forming a stack of sheets comprising a brake means placed at (in terms of sheet motion) the leading edge of the stack and downstream from a sheet transport means, the brake means having at least one brake roller driven at a lower peripheral speed than the speed of transport of the sheets and a timed sheet nip member adapted to engage a sheet and move it towards the brake roller.

An apparatus designed on these lines is to be seen in the German Pat. No. 3,007,435 and in it the brake means is made up of brake rollers which are driven at a speed that is lower than the sheet transport speed and against which the respective sheet to be retarded is pressed by an eccentric member running at the sheet transport speed. It this case it is therefore possible for the sheet to be braked to be propelled by the eccentric member, running at a higher speed than the respective brake roller over the respective brake roller. Therefore there is the danger of the sheet, while still moving at a relatively high speed, violently colliding with a stop mounted at the trailing edge of the stack so that the leading edge of the sheet will be damaged. A further danger with the known system is that the respective sheet will be differentially braked at the different braking rollers dependent on whether the sheet speed is nearer the speed of the brake rollers or nearer to the speed of the eccentric member cooperating therewith. The consequence is that the sheet will veer about an axis perpendicular to the plane of transport and this may cause a stoppage, something that will be the more likely at high sheet velocities. Although others have made attempts to remedy or improve such systems by replacing the eccentric sheet nip members by nozzles to press the respective sheet, that is to be slowed, down against the brake rollers, this has not proved to be a remedy to the shortcomings, since, more especially in the case of stiff material, the pressing forces due to the nozzles are insufficient to cause an even braking action. Furthermore, in such an apparatus the air coming from the nozzles is prone to cause undesired side-effects.

However, quite apart from the effectiveness or ineffectiveness of the retarding action of the arrangement in accordance with the German Pat. No. 3,007,435, there is in any case the difficulty that the sheets to be deposited in a stack are not reliably straightened or flattened. Although a flattening effect is produced by the inertial forces coming into effect during the braking operation, because of the comparatively small mass such forces have not proved to be great enough to cause effective flattening. There is furthermore the danger of the leading edge of the sheet moving downwards onto the top of the stack even while the sheet is moving. The consequence of this may then be damage to the top side of the sheet on top of the stack. This danger is particularly likely when dealing with sheets that have had their surfaces treated as, for example, when the sheets are freshly lacquered. A further undesired effect is that of the sheet curling, as it will be prone to do if it has a tendency to curl due to a coating of lacquer or owing to drying etc. This is therefore a further reason likely to be a source of functional disorders.

SUMMARY OF THE INVENTION

One object of the present invention is therefore to overcome the disadvantages of the prior art.

A further object of the invention is to devise an apparatus of the sort noted that makes possible reliable slowing down or braking of the sheets in a way independent of the sheet speed and the material thereof.

A still further object is to design such an apparatus that reliably straightens out the sheets.

Another aim of the invention is to devise such an apparatus that gently handles the sheets.

In order to achieve these or other objectives, in the present invention the brake means, whose sheet nip member or members is in the form of at least one segment able to be driven at a speed equal to the speed of the braking roller cooperating therewith when tripped by the sheet, is placed at the downstream end of at least one suction belt designed to receive the respective sheets from a sheet processing machine, and at least one blow tube is placed over the stack and downstream from the said brake roller, such blow tube, that is supplied with air under pressure, having at least one nozzle generally directed in the direction of sheet transport.

The air emerging from the blow tube or tubes in the form of at least one jet gives the useful effect not only of reliably flattening each sheet while its trailing part is being held and guided by the suction belt or belts, but furthermore, because of the covering over or obstruction of the nozzle or nozzles caused by the sheet, means that there is an increased air velocity and therefore a suction effect which draws the sheet against the blow tube or tubes without however the sheet making contact therewith so that during transport over the sheet stack the moving sheet is kept clear of the top of the stack. This ensures that each sheet is fully flattened out when deposited on the top of the stack and that there is effectively no chance of the topmost sheet on the stack being scratched or scoured. The suction belt or belts not only guarantee keeping a hold on the trailing part of the sheet as necessary for a flattening of the front sheet parts acted upon by the blow tube or tubes, but furthermore mean that the sheet may be transported reliably without its top face fouling parts of the apparatus, this being a very useful effect when it is a question of conveying freshly lacquered sheets with their wet sides upwards. Despite the supporting action produced by the blow tube or tubes it is nevertheless possible to be certain of an effective retarding action on the sheets, since the segment-like sheet nip member or members reliably cause the respective sheet, whatever its velocity and the stiffness of its material, to engage the respective brake roller. The segment or segments furthermore make possible a relatively sharp deflection of the sheet, this facilitating release of the sheet from the blow tube or tubes and simultaneously opening up a gap for the insertion of the next sheet, this then completing the release of the respective preceding sheet from the blow tubes. Since the segment or the segments are driven at the speed of the brake roller adapted for cooperation therewith, there is the advantage of there not being any lead or lag therebetween. The tripping of the segment or segments by a respective sheet that is to be retarded furthermore makes it possible to change the cycle speed of the apparatus to be in accord with any sheet size and the working speed of the sheet processing machine whose sheets are to be stacked automatically. The advantages to be gained with the apparatus of the invention are to be therefore perceived more particularly in its straightforward, readily comprehended design, its great reliability and the gentle handling of the sheets conveyed by it.

As part of further developments of the invention it is possible to have a plurality of blow tubes spread out over the width of the stack of sheets so that they may be adjusted. These measures make possible adaption to the distribution of the blow tubes to the respective sheet size being handled so that in any event one may be certain of reliable entrainment of the side edges of the sheets.

A further possible development is for the blow tubes to have longitudinal flats, at least in their lower parts. This yields the advantage of sheets engaging the lower flats of the tubes over large contact areas.

In keeping with yet another preferred measure of the invention, the plane of transport of the suction belt or belts may be at the same level as the lower side of the blow tube or tubes. This facilitates the desired shutting off of the nozzles by the sheets and for this reason the attainment of the desired suction effect.

It is furthermore possible for the top or apex of the brake roller or rollers to be placed at a somewhat lower level than the lower side of the blow tube or tubes. This will lead to a particularly reliable release of the sheets from the blow tube or tubes and there will therefore be a large gap for insertion of the respective following sheet.

As particularly simple and straightforward design is made possible if the brake roller or rollers are mounted on a continuously turning shaft and the segment or segments are mounted on a shaft that may be coupled with such shaft for performing part of a turn in step with the desired operation of the apparatus.

A further and more particularly preferred feature of the invention is one in which the brake roller for cooperation with the segment or segments is in the form of a suction wheel placed thereunder. This means that the respective sheet to be braked is engaged at its lower face and, whatever the length of the sheet, is retained on the suction wheel till the full periphery of the segment has made rolling engagement with the end part of the sheet. This ensures that the end of the sheet is in each case pulled downwards, this being the way to guarantee a particularly effective release of the sheet from the suction tube or tubes and the formation of a large gap for the next sheet to be received in. Yet a further beneficial effect is that segments with a particularly short sheet engaging periphery may be employed so that the upper surface of the sheets will be gently treated, this being a particularly telling advantage. When handling sheet material with particularly sensitive surfaces one may usefully dispense with any nipping action on the sheet between the suction wheel and its segment. On the other hand if a nipping action is desired, the vacuum effective at the suction wheel or wheels may simply be switched off.

Further useful and convenient developments of the invention will be seen from the claims.

A detailed account will now be given of one working example of the invention using the figures of the drawings.

LIST OF THE VARIOUS VIEWS OF THE FIGURES

DETAILED ACCOUNT OF WORKING EMBODIMENT OF THE INVENTION

Figures 1, 2, 4, 5, 6:
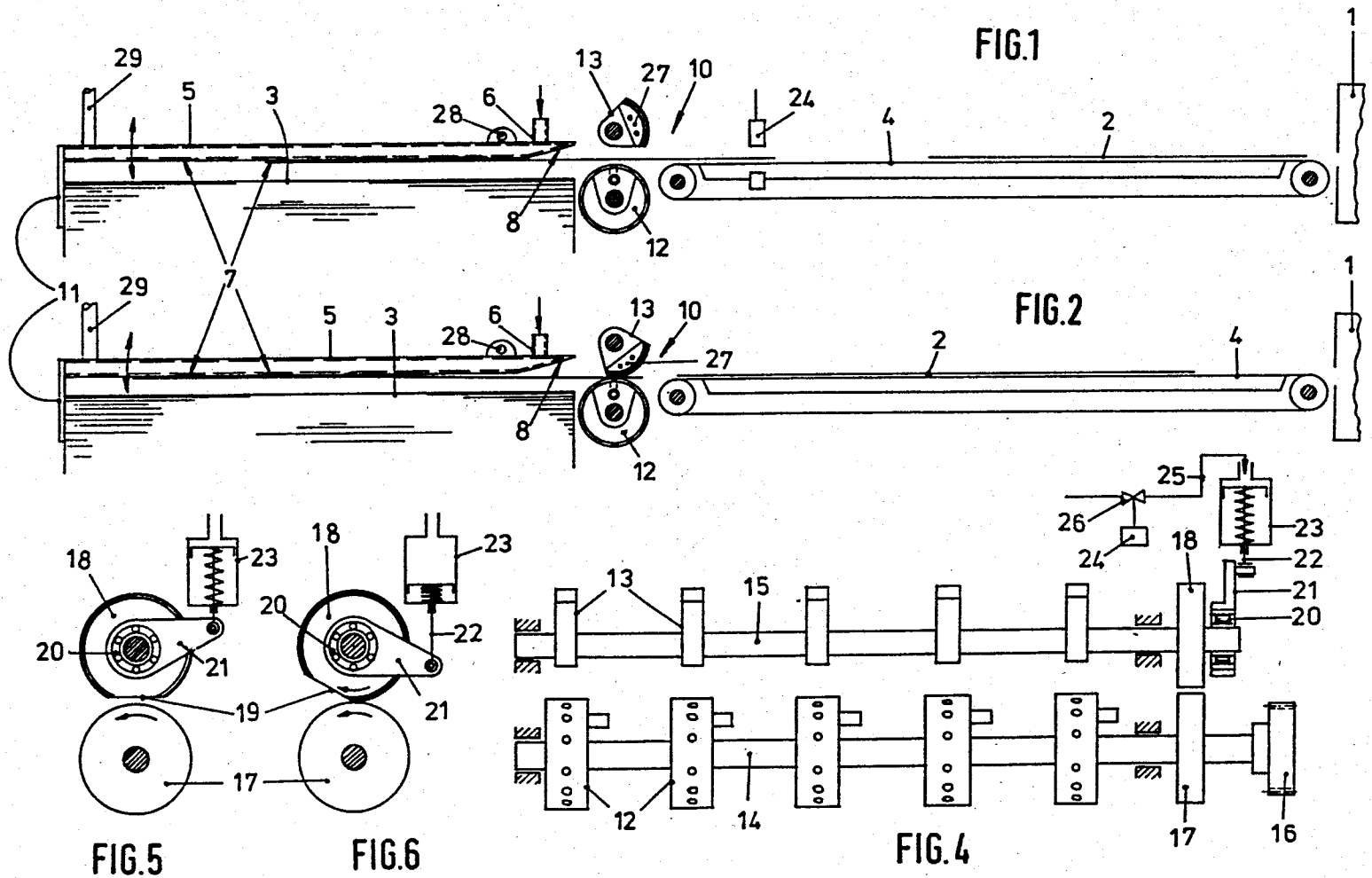
FIG. 1 shows the working position of the stacking apparatus of the invention immediately prior to tripping of the braking means in a diagrammatic side view.
FIG. 2 shows the arrangement of FIG. 1 after tripping of the brake means.
FIG. 4 is an end-on view of the brake means of the present invention.
FIGS. 5 and 6 show the drive systems connected with the two shafts of the brake means in lateral views corresponding to the working stages to be seen in FIGS. 1 and 2.

As will best be seen from FIGS. 1 and 2, the apparatus of the invention serves to deposit sheets 2 coming from a sheet processing machine, such as a lacquering machine etc., to build a stack 3. The sheets 2 leaving the processing machine 1 are taken over by a transport means running at the same speed as the processing machine and placed on the output side thereof. This transport means is in the form of a number of suction belts 4 running at the said speed and spaced out evenly across the width of the sheet transport path. The design and workings of a suction belt being well known, no detailed description thereof is needed in the present context. In the suction belt part of the apparatus it is only the undersides of the sheets 2 that are engaged. The top surfaces with the finish produced in the processing machine 1, as for example a lacquer finish, is not contacted at this stage, this ensuring a damage-free and reliable transporting action. To flatten and pull the sheets 2 out to their full length and to keep them clear of the top side of the stack during transport there is a rake-like array of blow tubes 5 evenly spaced out over the width of the sheets over the stack so that the tubes extend in the direction of conveyance. The blow tubes 5 are supplied with compressed air by way of a supply line 6 and their lower sides each have a number of nozzles 7 placed one behind the other and each directed obliquely in the direction of transport.

The transport plane defined by the suction belts 4 is generally at the same level as the lower sides of the blow tubes that are parallel thereto. As soon as the leading edge of a sheet moved along by the suction belts 4 moves under the blow tubes, it covers or obstructs the nozzles 7. The reduction in free flow cross section for the air causes the air emerging from the obstructed nozzles to so increase in velocity that the pressure drops to the pressure of the surroundings so that the sheet 2 is sucked towards the blow tubes 5. The air flow coming into existence between the blow tubes and the attracted sheet 2 however keeps the sheet from making direct or physical contact with the blow tubes so that a certain clearance is maintained betwixt the underside of the sheet and the top of the stack and the sheet is floatingly supported without a mechanical, but rather by an aerodynamic supporting action. The air issuing at a high speed in the sheet transport direction causes the respectively floatingly supported sheet to be acted upon in the direction of sheet transport at the same time, this favoring a straightening out or flattening of the sheet as long as same has its trailing part engaged by the suction belts 4. The suction belts 4 and the blow tubes 5 are able to be adjusted in their distribution and spacing out over the width of the apparatus in order to ensure reliable support of the sheets 2 right over their full areas, special attention being given to their side edges. The upstream ends of the blow tubes 5 are made oblique at 8 to guide in the sheets. The blow tubes 5 may be adjusted in height. In the illustrated working example the blow tubes 5, as will be furthermore seen from FIGS. 1 and 2, are supported by a shaft 28, stretching across the sheet transport path, and able to be pivoted thereabout so the trailing ends of the blow tubes may be adjusted in height, as is marked by a two-headed arrow. This makes it possible to deflect the leading sheet edges upwards or downwards, this being a particularly useful adjustment option when dealing with the sheets that have been partly inked so that the top side of the stack will not be on the level. The shaft may extend across the full width of the apparatus, or there may be a separate pivot means for each tube and not a continuous support shaft 28. In this case it would then be possible to adjust the heights of the pivot shafts separately. The support and adjustment of the pivoting blow tubes 5 may be undertaken with a single threaded rod 29 or one such rod for each tube.

Figure 3:
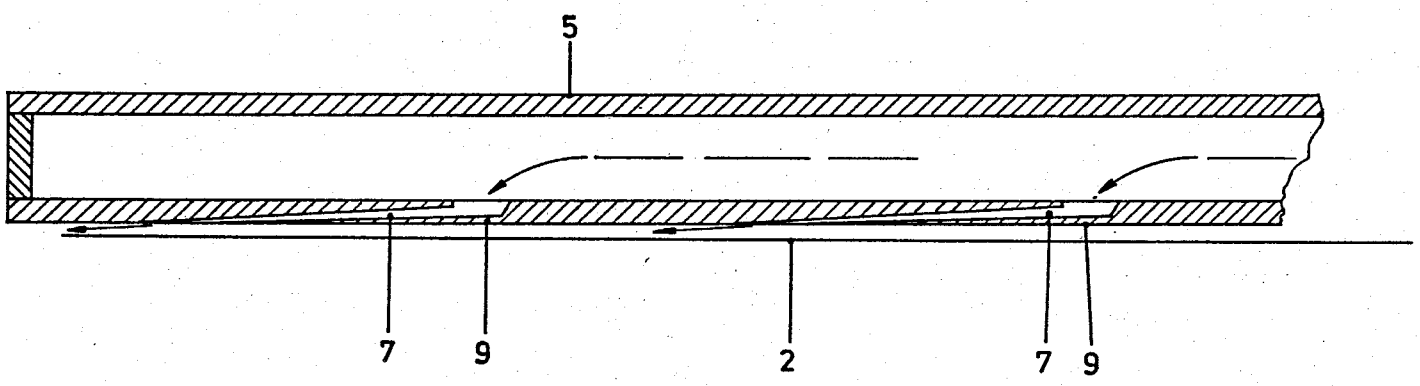
FIG. 3 is a longitudinal section of a blow tube.

As shown in FIG. 3, the blow tubes are of square cross section and closed at one end so that they have lower flats to constitute effective broad support surfaces. The nozzles 7 may be oblique holes. In the present embodiment the nozzles 7 are milled to produce the smallest possible angle of emergence, such milled cuts running, and being directed in, the direction of sheet transport. The depth of the cuts increases in an inward direction and the nozzles are covered over by inserted wedge-like plates 9 to such an extent that only the ends of the cuts are open to form air exit apertures.

At the leading edge of the stack, i.e. the edge which is to be front in terms of sheet motion, there is brake device 10 following the suction belts. This brake device is tripped on the passage of the trailing end of a respective sheet 2 to be stacked so that the sheet will be retarded in speed and will strike the stop 11 at the trailing or back side of the stack at such a reduced speed. The brake device 10 consists of a number of brake rollers 12 evenly spread out over the breadth of the apparatus and of segments 13 for cooperation with such rollers in nipping the sheet. As will be seen from FIG. 4, the brake rollers 12 and the segments 13 associated therewith, are fixedly mounted on respective shafts 14 and 15 running from one side to the other across the path of sheet transport. The shaft 14 mounting the brake rollers 12 is continuously run at such a speed that the surface speed of the brake rollers 12 is a certain desired amount less than the speed of the suction belts 4. This speed is produced by having step-down gearing which is driven from the suction belt 4 and of which in FIG. 4 only a spur wheel 16 mounted on the shaft 14 will be seen. The segments 13 are able to be tripped by the incoming sheets 2. To cause such tripping the shaft 15 mounting the segments 13 is able to be coupled with the continuously turning shaft 14 so that it is turned through part of a revolution.

This is made possible by gearing comprising friction gears 17 and 18 mounted on the shaft 14 with the brake rollers and, in the other case, on the shaft 15 with the segments 13. The two friction gears 17 and 18 have equal diameters. The radius of the segments 13 and of the brake rollers 12 is equal as well so that all surface speeds are equal. The friction gear 18 mounted on the segment shaft 15 is, as may best be seen from FIGS. 5 and 6, made with a chordal flat 19. As long as this flat 19 of the friction gear 18 is turned towards the other respective friction gear 17 there will be no mutual driving effect. This position is to be seen in FIG. 5. When the flat 19 is in a different position driving will take place. Such a driving condition will be seen in FIG. 6. Accordingly the flat 19 makes it possible to activate or trip the brake device on the passage of the trailing edge of a sheet. To cause such tripping the friction gear 18 having the flat 19 is turned by a starting device to such a degree that its outer face makes frictional contact with the respective friction gear 17 mounted on the permanently rotating shaft 14. In the course of the then ensuing rolling engagement of the round, flat-free part of the outer face of the friction gear on the mating friction gear 17 the segments 13 are moved out of the stand-by state shown in FIG. 1 into the operating position, in which the segment-like outer face rollers on the outer face of the associated brake roller 12, as will be seen from FIG. 2. When the flat-free periphery of the friction gear 18 has completed its engagement and the flat 19 is adjacent to the associated friction gear 17, the friction gear 18 with the flat 19 and the shaft 15 joined thereto and also the segments 13 mounted thereon will remain in the stand-by position to be shown in FIGS. 1 and 5, in which the segments 13 are swung clear of the respective brake rollers 12.

The starting device for operation of the friction gear 18 having the flat 19 comprises a freewheel 20 such as a ratchet or the like, and a rocking lever 21 for driving the shaft 15 mounting the friction gear 18. This lever 21 is acted upon by a thrust rod 22 that is moved by a drive actuator 23 in the form of a compressed air cylinder. The actuator 23 is operated by a sensor 24, placed (in terms of sheet motion) upstream from the brake device 10, such sensor detecting the end of a sheet 2 just as it is moving through the brake device 10. To effect this there is, as will be seen further from FIG. 4, a valve 26 placed in a supply line 25 running to the actuator 23. This valve is operated by the sensor 24. The sensor 24 may be in the form of a pressure switch with a nozzle sensing the passage of a sheet. In the present case the sensor 24, see FIG. 1, has a phototransmitter and a photoreceiver used therewith. They are located between two adjacent suction belts 4 opposite each other with plane of sheet transport between them. As long as there is sheet material between the transmitter and receiver the valve 26 is shut. As soon as the trailing sheet edge moves past the sensor the receiver responds and the valve 26 is opened so that the actuator 23 is supplied with compressed air and the thrust rod 22 moved outwards. This causes the lever 21 to be rocked so far that the flat-free part of the periphery of the friction gear 18 comes into engagement with the respective cooperating friction gear 17, as will be seen from FIGS. 5 and 6.

The brake rollers 12 are so arranged that their top limits are at a somewhat lower level than the lower sides of the blow tubes 5. A sheet coming into engagement with the brake rollers and so braked therefore has its trailing edge deflected downwards out of the transport plane so that the trailing part of the sheet is released from the blow tubes 5 and at the same time a gap is opened up for the following sheet. In the present embodiment the brake rollers 12 are in the form of vacuum suction wheels. The design and workings of a suction wheel are well known and not in need of a detailed description in the present context. The suction wheels forming the suction rollers 12 aspirate the sheet coming in contact therewith. The attracted sheet end at the same times remains in full engagement with the suction wheels irrespective of the size of the arcuate faces of the respective segments 13, something that not only has a useful effect as regards the desired straightening of the sheets, but furthermore makes possible a particularly large deflection of the trailing sheet edge from the plane of transport in a downward direction and therefore a reliable release of the respective sheet from the blow tubes 5. When the brake rollers 12, formed by the suction wheels, are connected with vacuum, it is sufficient for the segments 13 to only force the sheet to be braked so far down that it may be engaged by the suction nozzles of the suction wheels forming the suction rollers. As soon as this has happened, the sheet will be held by the suction effect and braked down to the speed of the brake rollers 12 without there being any mechanical nipping of the trailing sheet edge between the brake rollers 12 and their segments 13, this being a valuable advantage when handling sensitive materials. In such cases the segments used will have a radius generally less than the distance between their axis and the tops of the brake rollers 12.

In the illustrated embodiment the respective sheet 2 to be braked is pressed by the segments 13 against the brake roller 12. This may be advantageous when handling stiff material to obtain effective suction engagement. It would however be possible to simply turn off the vacuum in such cases. The segments 13 are provided with replaceable jaws 27 in the illustrated example. Such jaws may have different frictional properties and different curvatures in accordance with the purpose of use. To prevent high forces being produced if two sheets or thicker sheets should make their way to the brake device, the jaws 27 may be in the form of resilient cushion elements for the frictional coating. It would furthermore be possible for the frictional coating to be designed for this purpose and made with a suitable thickness or mounted on an elastic material.

What is claimed is:

1. In a stacker for accepting sheets from a sheet processing machine and depositing such sheets on a support so as to build a stack with a leading edge, comprising a brake device adapted to slow down said sheets on their way over said leading stack edge to be deposited on said stack, said brake device having at least one brake roller and means for driving it at a surface speed less than a speed of supply of said sheets to said brake device and a sheet nip member adapted to bring each sheet into engagement with said brake roller, the improvement comprising:

said nip member being in the form of a segment drivingly connected with said brake roller for causing rotation of the segment about an axis to which said segment is concentric, and said stacker further comprising tripping means for causing operation of said segment on the motion of such sheet towards said brake device, at least one suction belt for moving said sheets to said brake device and at least one blow tube placed over said stack and having at a lower side thereof at least one nozzle directed in the direction of transport of said sheets, said blow tube being pivotably supported at an upstream end thereof for turning about an axis normal to the direction of sheet transport, and a compressed air line for the supply of air to said at least one blow tube.

2. The stacker as claimed in claim 1 comprising a number of such blow tubes placed side by side and adjustably distributed over the width of the stack.

3. The stacker as claimed in claim 1 wherein said blow tube has a lower flat running along it.

4. The stacker as claimed in claim 1 wherein said blow tube has a number of such nozzles placed one behind the other in the length direction of said tube.

5. The stacker as claimed in claim 1 wherein said nozzle is in the form of a milled cut made in the wall of such blow tube, said tube further having a cover plate clear of an opening of said cut.

6. The stacker as claimed in claim 1 wherein said at least one suction belt defines a sheet transport plane that is generally at the same level as a lower side of said blow tube.

7. The stacker as claimed in claim 1 wherein said blow tube has a leading end which is made oblique and is turned downwards and in the direction of arrival of the sheets thereat.

8. The stacker as claimed in claim 1 wherein the top of the at least one brake roller is at a somewhat lower level than the lower side of the blow tube.

9. The stacker as claimed in claim 1 wherein said pivotal support of said tube may be adjusted in height.

10. In a stacker for accepting sheets from a sheet processing machine and depositing such sheets on a support so as to build a stack with a leading edge, comprising a brake device adapted to slow down said sheets on their way over said leading stack edge to be deposited on said stack, said brake device having at least one brake roller and means for driving it at a surface speed less than a speed of supply of said sheets to said brake device and a sheet nip member adapted to bring each sheet into engagement with said brake roller, the improvement comprising said nip member being in the form of a segment, a first shaft on which said brake roller is mounted, means for rotating said first shaft, a second shaft on which said segment is mounted and which is adapted to be rotated intermittently through part of one revolution, friction gears for drivingly connecting said first and second shafts, one of said friction gears being mounted on said second shaft and having a part-circular outer concentric face with a part of lesser diameter connecting two circumferential ends of said outer face, a starting device adapted to turn said gear with said part-circular face so as to come into contact with a further one of said friction gears and to be driven thereby, and said stacker further comprising tripping means for activating said starting device on the motion of such sheet towards said brake device, at least one suction belt for moving said sheets to said brake device and at least one blow tube placed over said stack and having at a lower side thereof at least one nozzle directed in the direction of transport of said sheets, and a compressed air line for the supply of air to said at least one blow tube.

11. The stacker as claimed in claim 10 wherein said starting device comprises a freewheel drivingly connected with said second shaft, a lever on said freewheel, an actuator for rocking said lever and a sensor placed upstream from said brake device for causing operation of said actuator.

12. The stacker as claimed in claim 11 wherein said actuator is in the form of an air-operated cylinder and piston unit having a valve to be operated by said sensor for supply of air to said actuator.

13. The stacker as claimed in claim 11 wherein said sensor comprises a phototransmitter and a photoreceiver placed in a space between two such suction bands so that vertically directed light from said transmitter may be interrupted by such sheets.

14. The stacker as claimed in claim 10 wherein said segment has a frictional coating thereon.

15. The stacker as claimed in claim 14 wherein said segment has a replaceable jaw comprising such coating.

16. The stacker as claimed in claim 10 wherein said brake roller placed under said segment is in the form of a suction wheel having a vacuum line connection therewith.

17. The stacker as claimed in claim 16 comprising means for turning off the connection of vacuum to said suction wheel.

18. The stacker as claimed in claim 16 wherein said segment has a radius that is slightly smaller than the distance between its axis from the top of the brake roller, in the form of a suction wheel, associated therewith.

19. The stacker as claimed in claim 10 wherein said segment has resilient support element with a frictional coating thereon.

* * * * *